US008391734B2

(12) United States Patent
Minbu

(10) Patent No.: US 8,391,734 B2
(45) **Date of Patent: *Mar. 5, 2013**

(54) IMAGE FORMING APPARATUS

(75) Inventor: Ryuuichi Minbu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/231,564

(22) Filed: Sep. 13, 2011

(65) Prior Publication Data

US 2012/0003017 A1 Jan. 5, 2012

Related U.S. Application Data

(63) Continuation of application No. 12/326,532, filed on Dec. 2, 2008, now Pat. No. 8,036,550.

(30) Foreign Application Priority Data

Dec. 3, 2007 (JP) ..... 2007-312310

(51) Int. Cl.
*G03G 15/00* (2006.01)

(52) U.S. Cl. ..... 399/45; 399/101; 399/396

(58) Field of Classification Search ..... 399/45, 399/67, 75, 101, 396

See application file for complete search history.

(56) References Cited

U.S. PATENT DOCUMENTS

| | | | |
|---|---|---|---|
| 6,301,452 | B1 | 10/2001 | Yoshizawa |
| 6,901,234 | B2 | 5/2005 | Ogiyama et al. |
| 6,947,693 | B2 | 9/2005 | Kamiya et al. |
| 2004/0126125 | A1 | 7/2004 | Yoda et al. |
| 2004/0160646 | A1 | 8/2004 | Kudo et al. |
| 2006/0056884 | A1 | 3/2006 | Sawai et al. |
| 2007/0172273 | A1 | 7/2007 | Harada et al. |
| 2007/0258737 | A1 | 11/2007 | Ogiyama et al. |
| 2007/0269230 | A1 | 11/2007 | Hoshino et al. |
| 2008/0124155 | A1 | 5/2008 | Mimbu |
| 2008/0232867 | A1 | 9/2008 | Minbu et al. |

FOREIGN PATENT DOCUMENTS

| | | |
|---|---|---|
| JP | 2002-156802 | 5/2002 |
| JP | 2002-258660 A | 9/2002 |
| JP | 2003-76159 A | 3/2003 |
| JP | 2007-264593 | 10/2007 |
| JP | 4074025 | 2/2008 |

OTHER PUBLICATIONS

Japanese Office Action mailed on May 8, 2012, issued for JP Application No. 2007-312310, filed Dec. 3, 2007.

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

An image forming apparatus includes a plurality of image bearing members, a developing unit, an intermediate transfer belt, a secondary transfer body, and a registration roller. A linear speed difference between the intermediate transfer belt and the secondary transfer body is variably set based on a basis weight of a recording medium.

22 Claims, 4 Drawing Sheets

IMAGE FORMING APPARATUS

CROSS-REFERENCE TO RELATED APPLICATIONS

This application is a continuation of and is based upon and claims the benefit of priority under 35 U.S.C. §120 for U.S. Ser. No. 12/326,532, filed Dec. 2, 2008 now U.S. Pat. No. 8,036,550, and claims the benefit of priority under 35 U.S.C. §119 from Japanese Patent Application No. 2007-312310, filed Dec. 3, 2007, the entire contents of each of which are incorporated herein by reference.

BACKGROUND OF THE INVENTION

1. Field of the Invention

The present invention relates to conveying of a recording medium in an image forming apparatus.

2. Description of the Related Art

In an image forming apparatus such as a photocopier, a facsimile device, or a printing machine, toner images are formed on photoreceptors used as image bearing members to be electrostatically transferred to a recording medium such as a paper, an overhead projector (OHP) sheet, or a tracing paper and the transferred toner images are fixed and then a copied output is obtained.

The copied output can include a single color image or a full color image. As one of structures to form the image of the colors, a tandem type is known in which even when a full color image is output, the same level of output speed can be achieved as that of when a monochrome image is output.

In the tandem type image forming apparatus, each of image forming units corresponds to one of colors and includes the photoreceptor and a part of a device that performs an image forming process for the photoreceptor. The image forming units are arranged side by side. Images are sequentially transferred to a belt rotating around the image forming units or sequentially transferred to a recording medium such as a sheet fed by another belt and overlapped. Thus, a color image is obtained.

In the tandem type image forming apparatus, either of an intermediate transfer system and a direct transfer system can be used. In the intermediate transfer system, images formed on the photoreceptors are sequentially temporarily transferred to an intermediate transfer belt used as an intermediate transfer body by a primary transfer device, and then the images on the intermediate transfer belt are secondarily transferred to the recording medium, such as the sheet or the transfer paper, at one time by a secondary transfer device. On the other hand, in the direct transfer system, images formed on the photoreceptors are sequentially and directly transferred by a transfer device to the recording medium, such as the transfer paper, fed by a feeding belt.

In the tandem type image forming apparatus, a transfer roller is arranged on an inner side of the intermediate transfer belt or the feeding belt as a transfer bias applying unit that applies a transfer bias when the images are transferred. The transfer roller applies the transfer bias to the belt in a state where the transfer roller contacts with the inner side of the belt.

In the primary transfer, the images of each color are sequentially transferred to the intermediate transfer belt in an overlapping manner to obtain a multi-color image, and the multi-color toner image is transferred to the transfer paper at one time in the secondary transfer.

The recording medium (hereinafter, "transfer paper") fed to a secondary transfer position where the secondary transfer is performed is held to be fed at a position of a transfer nip portion, a position of a registration roller, and a position of a feeding roller respectively. The transfer nip portion is formed with a secondary transfer roller and a backup roller that presses the intermediate transfer belt toward the secondary transfer roller. The registration roller sets a registration timing of the transfer paper fed to the transfer nip portion. The feeding roller is provided in a transfer path of the transfer paper fed from a paper feeding device.

When the transfer paper is fed to the transfer nip portion, the orientation of the transfer paper that is to enter into the transfer nip portion can be controlled by an entrance guide member and the like. A related technology has been disclosed, for example, in Japanese Patent Application Laid-open No. 2000-229748 and Japanese Patent Application Laid-open No. 2002-156802.

As described in Japanese Patent Application Laid-open No. 2000-229748 and Japanese Patent Application Laid-open No. 2002-156802, there is a problem that toner scattering occurs due to a phenomenon called "premature transfer" in which an electric discharge occurs before the transfer paper arrives at the nip portion in an entrance of the transfer nip portion. Toner scattering refers to a phenomenon that transfer toners borne on the intermediate transfer belt are scattered to be unexpectedly transferred to the transfer paper due to an occurrence of a premature transfer electric discharge between the transfer paper and the intermediate transfer belt at the location upstream from the transfer nip portion when the transfer paper makes an improper angle with respect to the intermediate transfer belt.

Especially, when a rear end portion of the transfer paper passes through the entrance guide member and the transfer paper returns to its original shape by the flexural rigidity determined by its thickness, the rear end portion comes into contact with the transfer belt unstably and in a vibrating manner. This can create a disorder of the toner images.

To prevent this problem, the entrance guide member needs to be arranged such that a contact between the transfer belt and the transfer paper does not occur. An end portion of the entrance guide member near the transfer nip is frequently arranged closer to the transfer nip portion.

However, if this configuration is adopted, at the instant when the rear end portion of the transfer paper comes loose from the entrance guide member after the direction of the transfer paper is controlled by the entrance guide member and the transfer paper returns to its original shape and moves toward the intermediate transfer belt due to the thickness of the transfer paper that determines its flexural rigidity, the transfer paper can hit the intermediate transfer belt. When the transfer paper hits the intermediate transfer belt, the impact is large and it may cause the disorder of the images to become large.

SUMMARY OF THE INVENTION

It is an object of the present invention to at least partially solve the problems in the conventional technology.

According to an aspect of the present invention, there is provided an image forming apparatus including a plurality of image bearing members on which a plurality of single-color latent electrostatic images are formed; a developing unit that develops the single-color latent electrostatic images to form a plurality of single-color toner images; an intermediate transfer belt on which the single-color toner images are sequentially overlapped to form a multi-color toner image; a secondary transfer body that transfers the multi-color toner image from the intermediate transfer belt to a recording medium;

and a registration roller used to feed the recording medium to the secondary transfer body. A linear speed difference between the intermediate transfer belt and the secondary transfer body is variably set based on a basis weight of the recording medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
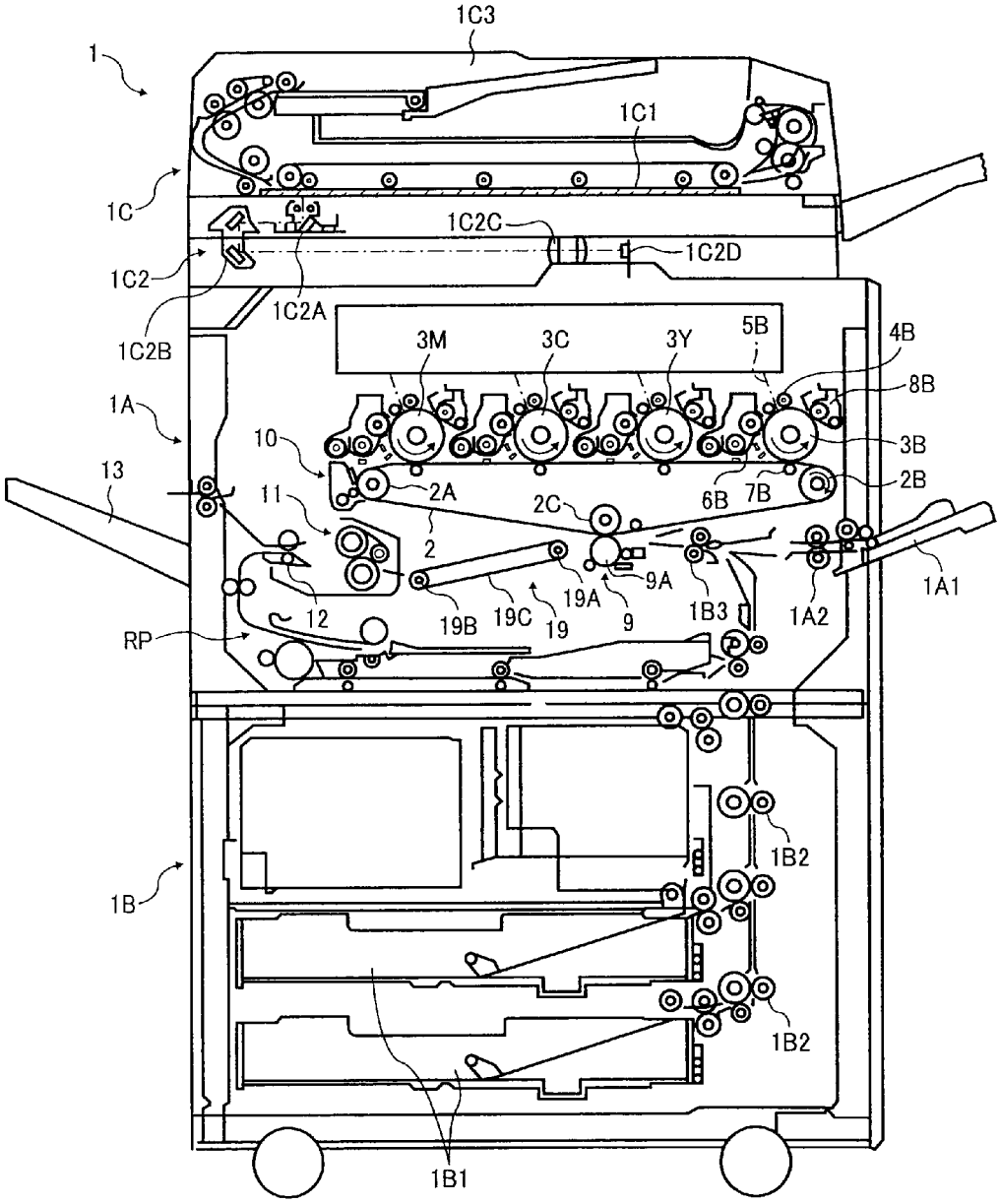
FIG. 1 is a schematic diagram of an image forming apparatus according to an embodiment of the present invention.

FIG. 1 is a schematic diagram of an image forming apparatus 1 according to an embodiment of the present invention.

The image forming apparatus 1 shown in FIG. 1 has a tandem type structure. That is, the image forming apparatus 1 includes a plurality of photoreceptors functioning as image bearing members that can form color images corresponding to color separation. The photoreceptors are arranged side by side. Single color toner images formed on the photoreceptors are overlapped and transferred to an intermediate transfer body as a multi-color image. The multi-color image is transferred to a recording medium, for example, a transfer paper (the description which follows is directed in particular to the transfer paper), at one time. The image forming apparatus may be implemented as a color printer, a color photocopier, a facsimile device, or a printing machine, for example.

As shown in FIG. 1, in the image forming apparatus 1 used as the color photocopier, an image forming unit 1A is situated in the center relative to the vertical direction. A paper feeding unit 1B is provided under the image forming unit 1A. A document scanning unit 1C having a document setting table 1C1 is provided above the image forming unit 1A.

In the image forming unit 1A, a transfer device including an intermediate transfer belt 2 having a surface extended in a horizontal direction is provided. Above the intermediate transfer belt 2, a structure to form color images with complementary relations to colors corresponding to color separation is provided.

In the image forming unit 1A, photoreceptors 3B, 3Y, 3C, and 3M, which can bear color images by toners of colors (yellow, magenta, cyan, and black) with the complementary relations, are arranged side by side along the extension surface of the intermediate transfer belt 2. In the following description, when the content is common in all the photoreceptors, the photoreceptors are represented as the photoreceptors 3.

Each of the photoreceptors 3B, 3Y, 3C, and 3M has a drum, and all the drums are rotatable in the same direction (in FIG. 1, counterclockwise). Around the drum, there are provided various devices (i.e. a charging device 4, a writing device 5, a developing device 6, a primary transfer device 7 functioning as one of transfer bias applying units, and a cleaning device 8) that perform image forming processes while the drum rotates. For convenience, "B" is added to the symbol indicating each of these devices to be intended for the photoreceptor 3B, i.e., a photoreceptor corresponding to black toner.

The intermediate transfer belt 2 corresponds to a primary transfer mechanism to which visualized images from image forming units respectively having the photoreceptors 3B, 3Y, 3C, and 3M are sequentially transferred. The intermediate transfer belt 2 is suspended over a plurality of rollers 2A to 2C. The intermediate transfer belt 2 has a structure such that the intermediate transfer belt 2 can rotate by being driven by the roller 2A as a driving roller in the same direction as those of the photoreceptors 3B, 3Y, 3C, and 3M at the place where the intermediate transfer belt 2 and the photoreceptors 3B, 3Y, 3C, and 3M meet each other.

The rollers 2A and 2B are used to form the extension surface of the intermediate transfer belt 2 and the roller 2C is disposed facing a secondary transfer device 9 via the intermediate transfer belt 2. In FIG. 1, the symbol 10 denotes a cleaning device for cleaning the intermediate transfer belt 2.

The secondary transfer device 9 includes a secondary transfer roller 9A as a secondary transfer body. The secondary transfer roller 9A is arranged to oppose the roller 2C over which the intermediate transfer belt 2 is suspended. The roller 2C is disposed on the opposite side of the intermediate transfer belt 2 to the secondary transfer roller 9A. A transfer nip portion is formed at the place where the secondary transfer roller 9A is in contact with the intermediate transfer belt 2 together with the roller 2C. At the transfer nip portion the images with the colors overlapped on the intermediate transfer belt 2 are transferred to the transfer paper at one time. The configurations of a secondary transfer mechanism including the secondary transfer roller 9A are described in detail below with reference to FIG. 2.

A feeding device 19 is disposed at the place to which the transfer paper moves after passing through the transfer nip portion on the intermediate transfer belt 2. The feeding device 19 has a belt 19C used to feed the transfer paper to a fixing device 11. In the feeding device 19, the belt 19C is suspended over a charging driving roller 19A and a driven roller 19B such that the transfer paper can be electrostatically attracted to the belt 19C to be transferred. The transfer paper is subjected to self stripping with curvature from the belt 19C at the driven roller 19B, and forwarded to the fixing device 11. The driven roller 19B is located immediately upstream from the fixing device 11 of a transfer path of the transfer paper. The attachment method of the transfer paper is not limited to the use of electrostatic force but, for example, a negative suction pressure can be used.

The transfer paper is fed to the secondary transfer position from the paper feeding unit 1B. The paper feeding unit 1B has a plurality of paper feeding cassettes 1B1, a plurality of transfer rollers 1B2 provided in the transfer path of a transfer paper fed from the paper feeding cassette 1B1, and a pair of registration rollers 1B3 located before the secondary transfer position. In this embodiment, the paper feeding unit 1B has a structure for feeding a different kind of transfer paper from that accommodated in the paper feeding cassettes 1B1 to the secondary transfer position in addition to the transfer path for a transfer paper fed from the paper feeding cassettes 1B1. This structure has a manual tray 1A1 and a pair of feeding rollers 1A2. The manual tray 1A1 can be folded to be in a plane of a wall of the image forming portion 1A.

A transfer path of a transfer paper fed from the manual tray 1A1 flows to the middle of the transfer path of the transfer paper from the paper feeding cassettes 1B1 to the registration rollers 1B3. A registration timing of a transfer paper fed from either of the transfer paths is set by the registration rollers 1B3.

Image information is obtained by scanning a document set on the document setting table 1C1 of the document scanning unit 1C or received from an external computer (not shown). The writing light of the writing device 5 (in FIG. 1, for convenience, it is represented by 5B) is controlled by the image information. Thus, the writing device 5 forms latent electrostatic images corresponding to the image information on the photoreceptors 3B, 3Y, 3C and 3M.

The document scanning unit 1C has a scanner 1C2 exposing and scanning a document on the document setting table 1C1. Above the document setting table 1C1, an automatic document feeding device 1C3 is provided. The automatic document feeding device 1C3 has a structure in which a document fed to the document setting table 1C1 can be reversed so that both sides of the document can be scanned. The scanner 1C2 includes a first traveling body 1C2A having a light source, a second traveling body 1C2B having an optical path conversion mirror, an imaging lens 1C2C, and a read sensor 1C2D. A document set on the document setting table 1C1 is scanned by the first and the second traveling bodies 1C2A and 1C2B. The light received during the scanning period is incident on the read sensor 1C2D through the imaging lens 1C2C and thereby information of the document is input as the image information.

The latent electrostatic images formed on the photoreceptors 3 (3B, 3Y, 3C, and 3M in FIG. 1) by the writing device 5 are visualized by the developing device 6 (represented by 6B in FIG. 1) to be primary-transferred to the intermediate transfer belt 2. After the toner images with the colors corresponding to the photoreceptors 3 are overlapped on the intermediate transfer belt 2, the overlapped images are secondarily transferred at one time to the transfer paper by the secondary transfer device 9.

The transfer paper to which the overlapped images are secondarily transferred bears an unfixed image on the surface. The fixing device 11 fixes the unfixed image. The fixing device 11 has a fixing belt heated by a heating roller and a pressing roller. The fixing belt and the pressing roller are opposed to each other in a contact manner so that the fixing device 11 has a belt fixing structure. This system has a nip area in the contact area between the fixing belt and the pressing roller so that the heating area for a transfer paper is relatively wide in comparison with a fixing structure taking a heat roller fixing system.

The transfer direction of the transfer paper which has passed the fixing device 11 can be switched by a transfer path switching claw 12 provided at the back of the fixing device 11 to a transfer path towards a discharging tray 13 or to a reversing transfer path RP.

In the image forming apparatus 1, the latent electrostatic images are formed on the uniformly charged photoreceptors 3 based on the image information obtained by exposing and scanning a document set on the document setting table 1C1 or the image information from a computer. After the latent electrostatic images are visualized by the developing device 6, the toner images are primary-transferred to the intermediate transfer belt 2.

When the toner image transferred to the intermediate transfer belt 2 is monochrome, the toner image is simply transferred to a transfer paper fed from the paper feeding unit 1B. When the toner images transferred to the intermediate transfer belt 2 are multicolor, the overlapped images are formed after a primary transfer is repeatedly performed and the overlapped images are secondarily transferred to a transfer paper at one time. An unfixed image on the transfer paper to which the toner image or the toner images is/are secondarily transferred is fixed by the fixing device 11, and then the transfer paper is guided to the discharging tray 13 or is reversed and guided to the registration rollers 1B3 again.

Figure 2:
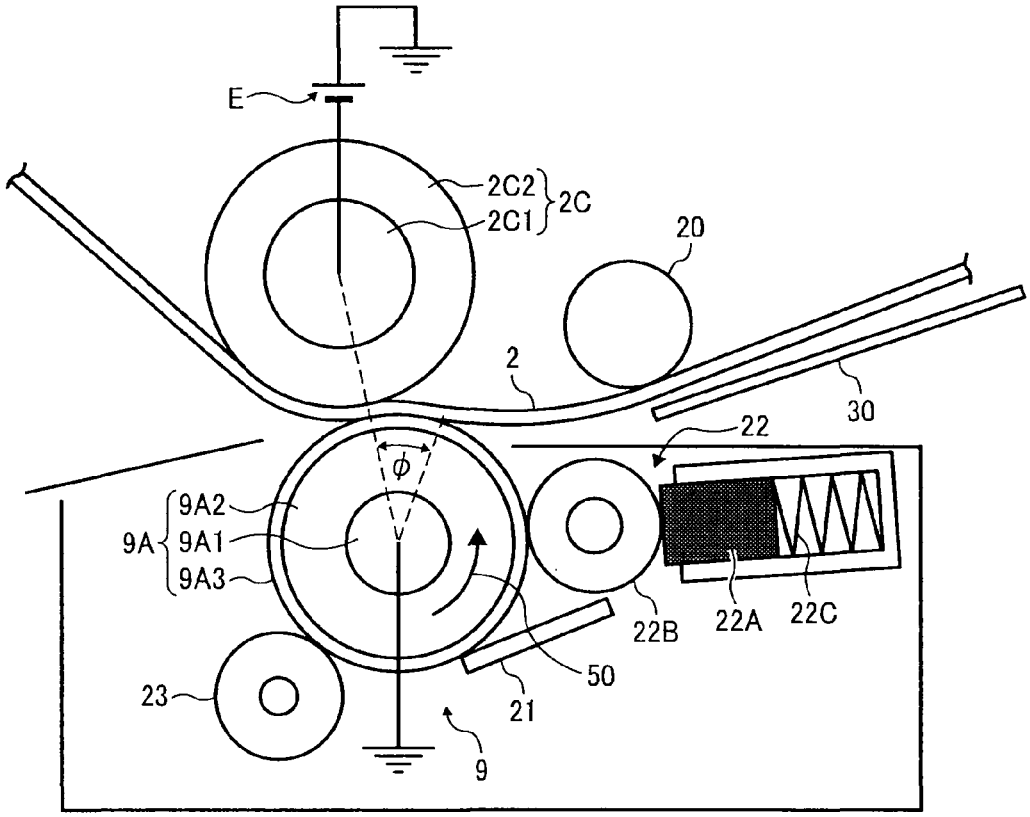
FIG. 2 is a schematic diagram of a secondary transfer mechanism of the image forming apparatus shown in FIG. 1.

FIG. 2 is a schematic diagram of the secondary transfer mechanism shown in FIG. 1. As shown in FIG. 2, the secondary transfer mechanism includes the backup roller 2C as a backup and a transfer bias applying unit, a pressing roller 20, a cleaning blade 21, a lubricant applying device 22, and a paper dust removing brush 23 as the prime constituents. The backup roller 2C is disposed facing the secondary transfer roller 9A via the intermediate transfer belt 2. The pressing roller 20 presses a portion of the intermediate transfer belt 2 that is represented by the symbol $\phi$ (a portion represented by the symbols "A" and "B" in FIG. 3) on the upstream side in a moving direction of the intermediate transfer belt 2 relative to a line connecting an axis of the backup roller 2C to that of the secondary transfer roller 9A (a line passing through a position represented by the symbol "A" in FIG. 3). The pressing roller 20 presses the portion of the intermediate transfer belt 2 in a state that the pressing roller 20 winds the portion around the secondary transfer roller 9A. The lubricant applying device 22 applies a lubricant, such as zinc stearate, to a surface of the secondary transfer roller 9A.

The function of the pressing roller 20 is to eliminate any small gap between the intermediate transfer belt 2 and a transfer paper on a side of an entrance to the secondary transfer mechanism and to prevent a pre-transfer electric discharge.

A power supply E is connected to the backup roller 2C. The power supply E applies a transfer voltage to the backup roller 2C such that a current of the backup roller 2C is constant.

When the secondary transfer roller 9A presses the intermediate transfer belt 2, the backup roller 2C presses the intermediate transfer belt 2 toward the secondary transfer roller 9A so that a nip gap is formed. When a recording medium such as a transfer paper passes through the nip gap, a bias voltage of the same polarity as that of the toners is applied to the backup roller 2C from the power supply E (in this embodiment, negative bias voltage is applied because the toners are negatively charged). As a consequence, the toner images on the intermediate transfer belt 2 are transferred to the recording medium.

The backup roller 2C includes a cylindrical core metal 2C1 made of metal, and an elastic layer 2C2 arranged on the outer circumferential surface of the core metal 2C1.

Regarding a surface resistance of the backup roller 2C, when the toner images are transferred to a small size paper such as an A5 size paper, an electric current flows more easily directly to a non-paper-traveling area of the backup roller 2C. As a consequence, an effective electric field strength needed for the transfer is not obtained and it causes an occurrence of a transfer failure image. To avoid any transfer failure, the surface resistance of the backup roller 2C is preferably equal to or more than 7.0 log Ω. The backup roller 2C has its surface resistance adjusted in such a manner that an ion conductive agent is added to the backup roller 2C. Thus, the surface resistance of the backup roller 2C is greater than that of a transfer paper, and it prevents the electric current from flowing through an end portion of the small size paper.

The secondary transfer roller 9A includes a cylindrical core metal 9A1 made of metal, an elastic layer 9A2 superimposed on the outer circumferential surface of the core metal 9A1, and a resin layer (a surface layer) 9A3 superimposed on the outer circumferential surface of the elastic layer 9A2.

The metal constituting the core metal 9A1 is not limited. However, for example, a metal material such as stainless or aluminum can be used for the core metal 9A1. A rubber material is usually used for the elastic layer 9A2. Thus, the elastic layer 9A2 is a rubber layer. Because sufficient elasticity to secure a sufficient nip of the secondary transfer roller 9A is required, the hardness of the elastic layer 9A2 is preferably equal to or less than JIS-A 70 degrees.

However, if the hardness of the elastic layer 9A2 is too small, a contact condition between the secondary transfer roller 9A and the cleaning blade 21 to clean the secondary transfer roller 9A becomes unstable and a correct cleaning angle is not attained. For this reason, the hardness of the elastic layer 9A2 is preferably equal to or more than JIS-A 40 degrees.

If the secondary transfer roller 9A is made of an insulator, the secondary transfer roller 9A cannot perform a function to transfer the toner images to the recording medium such as the transfer paper. Thus, a rubber material used for the secondary transfer roller 9A needs to have a conducting function. For the above reasons, the elastic layer 9A2 is made of epichlorohydrin rubber whose hardness is JIS-A 50 degrees.

As the rubber material having a conducting function, any of Ethylene-Propylene-Diene Methylene linkage (EPDM) in which carbon is dispersed, silicon rubber in which carbon is dispersed, nitrile butadiene rubber (NBR) having ion conducting function, and urethane rubber having ion conducting function, for example, can be used. Most of rubber materials have strong chemical affinities for a toner and the coefficient of friction of each of them is large. However, because both low frictional properties and good toner releasability are required for the surface layer 9A3 that contacts with the cleaning blade 21, fluororesin-based resin to which rheostatic control is applied such that its resistance is adjusted is used.

The secondary transfer roller 9A is rotated while in contact with the intermediate transfer belt 2 as the intermediate transfer body. Therefore, if a very small linear speed difference occurs between the intermediate transfer belt 2 and the secondary transfer roller 9A, it can affect a driving of the intermediate transfer belt 2. For this reason, good slip properties (a reduction of a friction between the secondary transfer roller 9A and the intermediate transfer belt 2) are required for the uppermost surface layer of the secondary transfer roller 9A. The coefficient of friction of the uppermost surface layer of the secondary transfer roller 9A is preferably set to be equal to or less than 0.3.

Because the images with the colors have to be superimposed and transferred onto the intermediate transfer belt 2 without an occurrence of a color shift, it is necessary to drive the intermediate transfer belt 2 precisely at a constant speed. Thus, disturbing the speed of the intermediate transfer body must be prevented. Therefore, the coefficient of friction is of importance.

Regarding the influence of the coefficient of friction, there are still other reasons for selecting a low coefficient of friction as described below. In the configurations shown in FIG. 2, the cleaning blade 21 is provided on the surface of the secondary transfer roller 9A such that the toners can be cleaned. Therefore, if a coefficient of friction of the surface of the secondary transfer roller 9A is high, a driving torque of the secondary transfer roller 9A becomes large. As a consequence, there is a possibility of troubles such as spooling up of the cleaning blade 21. For this reason, it is important to select the low coefficient of friction.

As a configuration to stabilize the coefficient of friction of the surface of the secondary transfer roller 9A, the lubricant applying device 22 is provided before the location where a peripheral surface of the secondary transfer roller 9A comes into contact with the intermediate transfer belt 2 near the cleaning blade 21.

In this embodiment, the lubricant applying device 22 includes a solid lubricant 22A, a brush-like roller 22B, and a pressing spring 22C. The brush-like roller 22B is rotated together with the secondary transfer roller 9A and provides with the surface of the secondary transfer roller 9A the lubricant scraped off by the brush-like roller 22B after coming into contact with the solid lubricant 22A. A pressing spring 22C presses the solid lubricant 22A against the brush-like roller 22B with a predetermined pressure. In this embodiment, the lubricant is scraped off by the brush-like roller 22B, but the solid lubricant 22A may be applied directly to the surface of the secondary transfer roller 9A.

The paper dust removing brush 23 is provided upstream of the location where the cleaning blade 21 comes into contact with the secondary transfer roller 9A in a rotating direction of the secondary transfer roller 9A (in the direction of an arrow 50 in FIG. 2). The paper dust removing brush 23 can touch the surface of the secondary transfer roller 9A and prevents paper dust from going into and getting caught in a fore-end portion of the cleaning blade 21.

In the configuration shown in FIG. 2, the pressing roller 20 winds the intermediate transfer belt 2 around the peripheral surface of the secondary transfer roller 9A to reduce a gap between the intermediate transfer belt 2 and a transfer paper before the transfer nip portion. Thus, a pre-transfer electric discharge resulting from a size of the gap, the so-called Paschen discharge is prevented.

Figure 3:
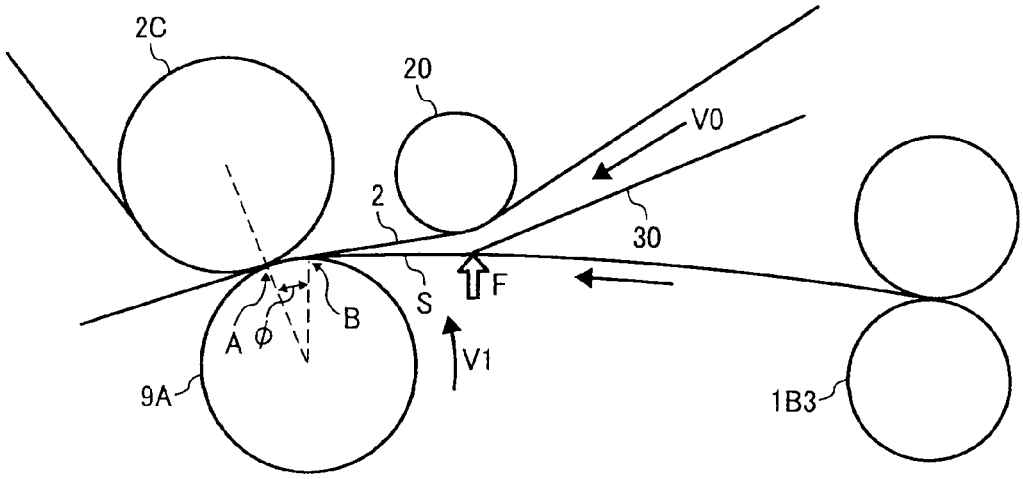
FIG. 3 is a schematic diagram for explaining behavior of a recording medium in the secondary transfer mechanism.

A transfer paper whose fore-end portion is held at the transfer nip portion, as shown by a symbol F in FIG. 3, receives a force in a direction that gets close to the intermediate transfer belt 2 about a portion of the transfer paper that is held at a transfer nip entrance. Therefore, a transfer entrance guide member (transfer entrance guide plate) 30 is provided to prevent a transfer paper from moving toward the intermediate transfer belt 2 unexpectedly so as not to cause the Paschen electric discharge. A resin such as polyethylene terephthalate (PET) and poly-carbonate (PC) is used for the transfer entrance guide member 30. In this embodiment, PC having a thickness of 0.5 mm is used.

Figure 4:
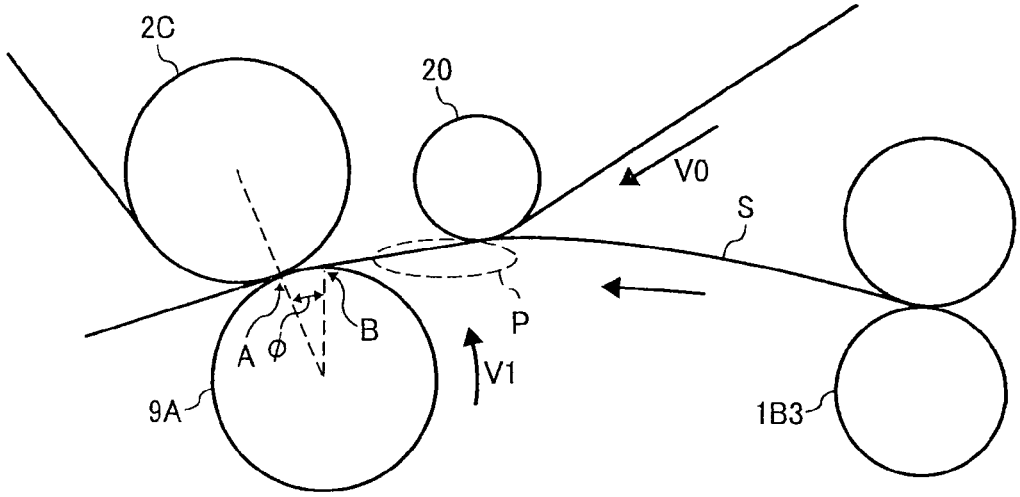
FIG. 4 is a schematic diagram for explaining behavior of the recording medium when configuration of the secondary transfer mechanism shown in FIG. 3 is modified.

On the other hand, to increase opportunities of contact between the intermediate transfer belt 2 and a transfer paper before the transfer for the purpose of eliminating the gap causing the Paschen electric discharge, for example, eliminating of a transfer entry guide member can be considered as shown in FIG. 4. However, in this case, the intermediate transfer belt 2 and the transfer paper contact each other from an upstream side of a transfer nip. In an area where the intermediate transfer belt 2 and the transfer paper contact each other (an area represented by a symbol P in FIG. 4), because a nip is not at all formed and a transfer paper is not fed at the nip, a contact state between the intermediate transfer belt 2 and the transfer paper becomes very unstable and the transfer paper comes into contact with or becomes detached from the intermediate transfer belt 2. Thus, an image on the transfer paper is disordered.

Therefore, the transfer entrance guide member 30 needs to be placed at such a location upstream of the transfer nip that a transfer paper does not come into contact with the intermediate transfer belt 2. The transfer entrance guide member 30 supports the transfer paper while the transfer paper is in the nip, but when a rear end portion of the transfer paper finally leaves the transfer entrance guide member 30, the transfer paper comes into contact with the intermediate transfer belt 2. Especially in the case of a transfer paper that possesses high stiffness such as a thick paper (its basis weight is equal to or more than 100 g/m$^2$), when a force suppressed by the transfer entrance guide member 30 is released, the force becomes large and an impact of the large force causes a problem of an occurrence of an image blurring.

Therefore, as the transfer entrance guide member 30, using a dumper can be considered that can absorb the impact and is made of a thin elastic plate capable of flexural deformation, for example. However, according to this configuration, the transfer entrance guide member becomes deformed because of its low stiffness and if it approaches the intermediate transfer belt 2, it may scatter the toners on the intermediate transfer belt 2 and the scattered toners may be attached to the transfer entrance guide member. In this case, an occurrence of a new problem that the attached toners are attached to the transfer paper to cause an occurrence of soils can be considered.

Figure 5:
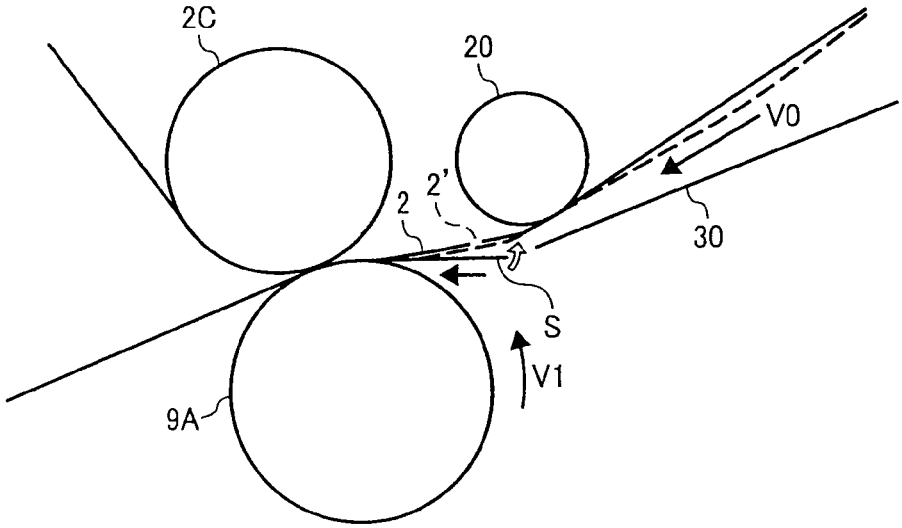
FIG. 5 is a schematic diagram for explaining operations of the secondary transfer mechanism used in the image forming apparatus shown in FIG. 1.

In this embodiment, when a thick paper is fed, a linear speed difference between the secondary transfer roller 9A as the secondary transfer body and the intermediate transfer belt 2 is set. Especially, as shown in FIG. 5, a linear speed V1 of the secondary transfer roller 9A is set to be slower than a linear speed V0 of the intermediate transfer belt 2 such that, as shown by a chain-double dashed line (represented by a symbol 2') in FIG. 5, the intermediate transfer belt 2 is slightly slacked at a portion upstream from the transfer nip of the intermediate transfer belt 2 to be given a dumper function at the portion.

Thus, because the intermediate transfer belt 2 is slightly slacked at the portion upstream from a secondary transfer nip portion of the intermediate transfer belt 2, a force with which the thick paper comes into contact with the intermediate transfer belt 2 when the rear end portion of the thick paper comes out of the transfer entrance guide member 30 is dispersed and relieved. Thus, an impact at a secondary transfer nip becomes weak so as to prevent an occurrence of a transfer blurring.

However, to provide the slack, if the linear speed difference between the secondary transfer roller 9A and the intermediate transfer belt 2 is set to be too large, a difference between speeds of the transfer paper and the intermediate transfer belt 2 becomes large. Thus, it can be expected that the image will be expanded or spotted at the secondary transfer nip portion.

To determine an appropriate range of the linear speed difference, a ratio of linear speeds between the intermediate transfer belt 2 and the secondary transfer roller 9A is selected and set variously and then evaluated using the image forming apparatus shown in FIG. 1. The evaluation results are shown in Table 1.

Evaluation conditions to obtain the results shown in Table 1 are as follows:

Evaluated Papers a transfer paper (1): FC white made by Ricoh (basis weight 250 g/m$^2$)

a transfer paper (2): Copy print paper (90) made by Ricoh (basis weight 100 g/m$^2$)

a transfer paper (3): Type 6200 made by Ricoh (basis weight 70 g/m$^2$)

a linear speed of the intermediate transfer belt): 200 mm/sec a tension of the intermediate transfer belt): 1.3 N/cm a pressure of the secondary transfer nip): 80 mN/cm$^2$.

TABLE 1

| | Paper type (1) (250 g/m$^2$) | | Paper type (2) (100 g/m$^2$) | | Paper type (3) (70 g/m$^2$) | |
|---|---|---|---|---|---|---|
| (V0-V1)/V0 | Transfer blurring | Spotted image | Transfer blurring | Spotted image | Transfer blurring | Spotted image |
| 0 | NA | N | NA | N | N | N |
| 0.002 | NA | N | NA | N | N | N |
| 0.003 | A | N | N | N | N | N |
| 0.004 | N | N | N | N | N | N |
| 0.006 | N | N | N | N | N | A |
| 0.008 | N | N | N | A | N | NA |
| 0.01 | N | N | N | A | N | NA |
| 0.011 | N | NA | N | NA | N | NA |
| 0.012 | N | NA | N | NA | N | NA |

N: No Occurrence
A: Occurrence (acceptable level)
NA: Occurrence (not acceptable level)

As is obvious from Table 1, the condition of the ratio of linear speeds on which the transfer blurring occurs varies depending on the basis weight of the transfer paper.

In the case of the transfer paper (3) whose basis weight is small, because the paper does not have sufficient body (its flexural rigidity is low), the force F acting on the transfer entrance guide member 30 is small and the transfer blurring does not occur.

In the cases of the transfer papers whose thicknesses are thick corresponding to the transfer papers (1) and (2) whose basis weights are large, if the ratio of the linear speeds: (V0–V1)/V0 is either zero or small, the transfer blurring occurs.

If the ratio of the linear speeds is set to be equal to or more than 0.003, the transfer blurring can be reduced within an acceptable range by the effect of the slack of the intermediate transfer belt 2 at the portion upstream from the secondary transfer nip portion.

Especially, in the case of a super thick paper such as the transfer paper (1), the occurrence of the transfer blurring cannot be prevented completely unless the ratio of the linear speeds is set to be equal to or more than 0.004.

However, if the ratio of linear speeds is increased, a difference at the nip portion between the speed of the transfer paper and a surface speed of the intermediate transfer belt becomes large. Thus, the toner images on the intermediate transfer belt are expanded and an image having transfer spots occurs.

The smaller the basis weight of the paper, the likelier the transfer spots occur. In the case of a plain paper whose thickness is relatively thin having about the basis weight of 70 g/m$^2$ such as the transfer paper (3), the linear speed difference needs to be set smaller.

Figure 6:
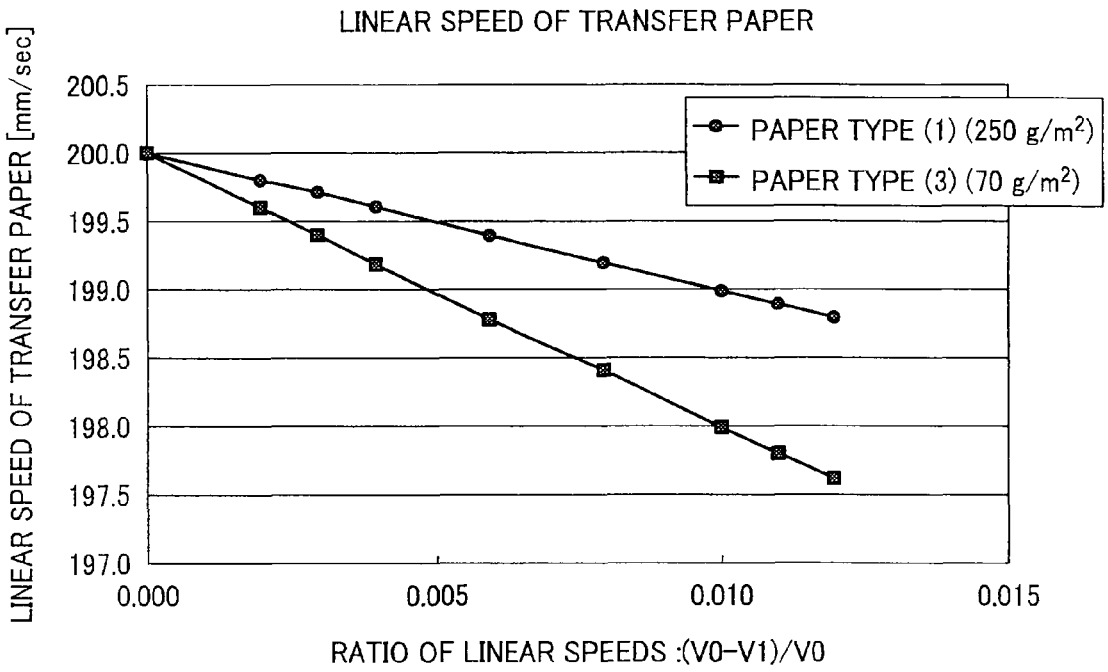
FIG. 6 is a diagram for explaining a relation between linear speeds of a transfer paper to ratio of linear speeds.

FIG. 6 is a graph for explaining a variation of the ratio of the speed of the transfer paper to the ratio of linear speeds between the intermediate transfer belt 2 and the secondary transfer roller 9A. The speed of the transfer paper is on condition that a rate of change of speed of the transfer paper V<the ratio of linear speeds: (V0–V1)/V0=0. The ratio of linear speeds between the intermediate transfer belt 2 and the secondary transfer roller 9A is selected and set variously by changing a surface linear speed V1 of the secondary transfer roller 9A.

As shown in FIG. 6, in the case of the transfer paper whose basis weight is small, the linear speed of the paper used as the transfer paper is changed by a variation of the ratio of linear speeds: (V0−V1)/V0. However, in the case of the paper whose basis weight is large, the linear speed of the paper is changed only by about a half of the variation of the ratio of linear speeds. The reason is as follows. In the case of the transfer paper whose basis weight is small, the linear speed of the transfer paper is almost the same as the surface linear speed of the secondary transfer roller 9A because, at the transfer nip portion, a slip occurs between the transfer paper and the intermediate transfer belt 2 and a slip does not occur between the transfer paper and the secondary transfer roller 9A. However, in the case of the transfer paper whose basis weight is large, the linear speed of the transfer paper is not the same as the surface linear speed of the secondary transfer roller 9A because a slip occurs even between the transfer paper and the secondary transfer roller 9A.

Thus, in the case of the transfer paper whose basis weight is large, even if the ratio of linear speeds between the intermediate transfer belt 2 and the secondary transfer roller 9A is varied, a spotted image does not occur because the linear speed difference between the transfer paper and the intermediate transfer belt 2 does not become so large.

In the image forming apparatus according to this embodiment, for practical purposes, a unit that changes the ratio of linear speeds between the intermediate transfer belt 2 and the secondary transfer roller 9A has only two modes: a thick paper mode for a thick paper whose basis weight is equal to or more than 100 g/m$^2$ and a plain paper mode for a plain paper. In the thick paper mode, the ratio of linear speeds between the intermediate transfer belt 2 and the secondary transfer roller 9A is set in the range of 0.003≦the ratio of linear speeds (V0−V1)/V0≦0.01. In the plain paper mode, the ratio of linear speeds is set to be less than 0.003. However, the number of the paper modes based on the basis weight of the transfer paper is preferably increased such that an optimum ratio of linear speeds can be set.

In this embodiment, a transfer roller is used as the secondary transfer body, but a transfer belt can be used in place of the roller. In the case of using the transfer belt, the same effect can be provided as in the case of using the roller.

According to an aspect of the present invention, because an occurrence of a transfer blurring is prevented, it is possible to prevent an occurrence of a disorder of an image.

According to another aspect of the present invention, it is possible to change a speed easily with a simple configuration.

According to still another aspect of the present invention, it is possible to set a linear speed difference precisely.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of image bearing members on which a plurality of single-color latent electrostatic images are formed;

a developing unit that develops the single-color latent electrostatic images to form a plurality of single-color toner images;

an intermediate transfer belt on which the single-color toner images are sequentially overlapped to form a multi-color toner image;

a driving roller over which the intermediate transfer belt is suspended and that rotates the intermediate transfer belt;

a secondary transfer body that transfers the multi-color toner image from the intermediate transfer belt to a recording medium; and a registration roller used to feed the recording medium to the secondary transfer body; wherein when a basis weight of the recording medium is equal to or more than 100 g/m$^2$, a speed of the secondary transfer body is slower than a speed of the driving roller.

2. The image forming apparatus according to claim 1, further comprising a transfer entrance guide plate that is provided at an upstream side from a transfer nip portion in a transfer direction of the recording medium, the transfer nip portion being where the intermediate transfer belt comes in contact with the secondary transfer body; wherein the transfer entrance guide plate is, with respect to the recording medium, provided in a side where the toner image is to be transferred.

3. The image forming apparatus according to claim 1, further comprising:

a backup-roller that comes in contact with the secondary transfer body via the intermediate transfer belt; and a pressing roller that is, with respect to the-backup roller, provided at an upstream side from the transfer nip portion.

4. The image forming apparatus according to claim 1, further comprising a lubricant applying device that applies lubricant to a surface of the secondary transfer body.

5. The image forming apparatus according to claim 4, wherein a coefficient of friction of a surface of the secondary transfer body is set to be equal to or less than 0.3.

6. An image forming apparatus comprising:

a photoreceptor;

a primary transfer roller that transfers a toner image from the photoreceptor onto an intermediate transfer belt;

a secondary transfer body that transfers the toner image from the intermediate transfer belt onto a sheet; and a driving roller that drives the intermediate transfer belt, wherein when a basis weight of the sheet is equal to or more than 100 g/m$^2$, a speed of the secondary transfer body is slower than a speed of the driving roller.

7. The image forming apparatus according to claim 6, further comprising a backup roller that comes in contact with the secondary transfer body via the intermediate transfer belt, wherein the backup roller is connected to a power supply, the power supply applying a transfer voltage to the backup roller.

8. The image forming apparatus according to claim 6, wherein the photoreceptor is of a plurality of photoreceptors linearly arranged on the intermediate transfer belt.

9. The image forming apparatus according to claim 6, further comprising a transfer entrance guide plate that is provided at an upstream side from a transfer nip portion in a transfer direction of the sheet, the transfer nip portion being where the intermediate transfer belt comes in contact with the secondary transfer body; wherein the transfer entrance guide plate is, with respect to the sheet, provided in a side where the toner image is to be transferred.

10. The image forming apparatus according to claim 6, further comprising:

a backup-roller that comes in contact with the secondary transfer body via the intermediate transfer belt; and a pressing roller that is, with respect to the-backup roller, provided at an upstream side from a transfer nip portion.

11. The image forming apparatus according to claim 6, further comprising a lubricant applying device that applies lubricant to a surface of the secondary transfer body.

12. The image forming apparatus according to claim 6, wherein a coefficient of friction of a surface of the secondary transfer body is set to be equal to or less than 0.3.

13. An image forming apparatus comprising:

a photoreceptor;

an intermediate transfer belt that receives a toner image from the photoreceptor;

a secondary transfer body that transfers the toner image from the intermediate transfer belt onto a sheet; and a driving roller that drives the intermediate transfer belt, wherein when a basis weight of the sheet is equal to or more than 100 $g/m^2$, a linear speed of the secondary transfer body is slower than a linear speed of the intermediate transfer belt.

14. The image forming apparatus according to claim 13, wherein $0.003<(V0-V1)/V0<0.01$ is satisfied, where V0 is the linear speed of the intermediate transfer belt and V1 is the linear speed of the secondary transfer body.

15. The image forming apparatus according to claim 13, wherein the secondary transfer body includes a driving unit that is separated from the driving roller.

16. The image forming apparatus according to claim 13, wherein a transfer roller is used as the secondary transfer body.

17. The image forming apparatus according to claim 13, wherein a transfer belt is used as the secondary transfer body.

18. The image forming apparatus according to claim 13, wherein a coefficient of friction of a surface of the secondary transfer body is set to be equal to or less than 0.3.

19. The image forming apparatus according to claim 13, wherein a surface of the secondary transfer body is coated with lubricant.

20. The image forming apparatus according to claim 13, further comprising a backup roller that comes in contact with the secondary transfer body via the intermediate transfer belt, wherein the backup roller is connected to a power supply, the power supply applying a transfer voltage to the backup roller.

21. The image forming apparatus according to claim 13, further comprising:

a backup-roller that comes in contact with the secondary transfer body via the intermediate transfer belt; and a pressing roller that is, with respect to the-backup roller, provided at an upstream side from a transfer nip portion.

22. The image forming apparatus according to claim 13, further comprising:

a transfer entrance guide plate that is provided at an upstream side from a transfer nip portion in a transfer direction of the sheet, the transfer nip portion being where the intermediate transfer belt comes in contact with the secondary transfer body, wherein the transfer entrance guide plate is, with respect to the sheet, provided in a side where the toner image is to be transferred.

* * * * *